US005267465A

United States Patent [19]

Gilman

[11] Patent Number: 5,267,465

[45] Date of Patent: Dec. 7, 1993

[54] DUAL CLAMP

[76] Inventor: Gary Gilman, 1510 S. Utica, Denver, Colo. 80219

[21] Appl. No.: 922,694

[22] Filed: Jul. 30, 1992

[51] Int. Cl.[5] ..... B21D 1/12

[52] U.S. Cl. ..... 72/422; 72/705; 294/104

[58] Field of Search ..... 72/308, 422, 705; 294/81.61, 87.1, 97, 104

[56] References Cited

U.S. PATENT DOCUMENTS

| | | | |
|---|---|---|---|
| 2,500,055 | 3/1950 | Baker | 294/81.61 |
| 3,194,599 | 7/1965 | Ambill | 294/81.61 |
| 3,352,591 | 11/1967 | Casey | 294/104 |
| 4,238,951 | 12/1980 | Grainger et al. | 72/705 |
| 4,770,025 | 9/1988 | Graf | 72/705 |

*Primary Examiner*—Lowell A. Larson
*Attorney, Agent, or Firm*—Bruce E. Dahl

[57] ABSTRACT

A dual clamp for automotive frame straightening machines includes a first clamp assembly and a second clamp assembly both of which are slidably mounted to an elongated slide bar. The first and second clamp assemblies are identical and comprise respective first and second pivoting jaws pivotally mounted to corresponding first and second sliding jaws. A chain interconnects the lever end of the first pivoting jaw and the lever end of the second pivoting jaw, so that when a pulling force is applied to the chain, the chain simultaneously pulls on both clamps and increases the clamping force of each respective clamp assembly.

12 Claims, 2 Drawing Sheets

DUAL CLAMP

BACKGROUND OF THE INVENTION

1. Field of the Invention

The present invention relates to clamps and clamping apparatus in general and in particular to an improved clamp for use with automotive frame straightening machines.

2. Background of the Invention

Automobile frame straightening machines are used in the automobile repair and restoration industry to straighten and re-align damaged automobile frames. A typical frame straightening machine or "rack" may include a base frame for holding and securing the automobile to the rack, along with several hydraulic jacks for pulling the damaged frame back into alignment. Generally speaking, a person seeking to repair a damaged frame will first secure the automobile frame to anchor points on the rack and then connect one or more of the hydraulic jacks to certain strategic parts of the frame, so than when the hydraulic jacks are actuated, they will pull on the frame and bend it back into alignment. Because such frame racks are designed to be used on a wide variety of cars and trucks, the hydraulic jacks are usually permanently mounted to the frame straightening rack and are typically connected to the automobile frame by chains or cables that are in turn connected to individual clamps that have been secured to the frame.

The above-described frame straightening procedure is relatively straightforward for vehicles having the older body-on-frame type of construction, because the frames of such vehicles are generally made from heavy gage steel and are quite strong. Therefore, it is relatively easy to affix the clamps to any point on the frame without risk of locally crushing or damaging the frame. However, the frame straightening procedure is somewhat more difficult for automobiles having the newer type unibody construction. Essentially, automobiles having unibody construction rely on the body panels themselves to carry the majority of the structural loads and use only relatively light stiffener assemblies to carry and distribute to the body panels more concentrated loads. Most unibody automobiles will also have relatively heavy subframe assemblies to carry and distribute to the body stiffeners heavily concentrated loads, such as those imposed by the engine, transmission, and suspension assemblies. The relatively lightweight construction of unibody automobiles, therefore, makes it considerably more difficult to affix the currently available clamps to portions of the body or lightweight stiffener assemblies without deforming, or even crushing, the unibody structure.

While numerous kinds of clamps have been developed in an effort to reduce the chances of damaging such unibody structures, they cannot always be clamped to those portions of the structure that would maximize the leverage applied to the unibody structure by the hydraulic jacks. As a result, it is often necessary to resort to several separate frame straightening operations with the clamp at separate locations before the frame can be completely re-aligned. For example, while a typical light frame or stiffener assembly for a unibody automobile has a square or rectangular cross-section, most body clamps currently available can only clamp a single wall of the square "tube" stiffener. Consequently, if a sideways pulling force is exerted on the clamp by the hydraulic jack, the clamp may bend or even tear the side wall of the stiffener member, causing yet more damage that will need to be repaired.

Consequently, there is a need for an improved clamp for automotive frame machines that can simultaneously grip both side walls of a square or rectangular frame stiffener or "tube" to allow greater side forces to be exerted on the member without risking substantial deformation and without the need to resort to multiple pulling operations. Ideally, such a clamp should be "self-energizing," i.e., the clamping force should increase in relation to the pulling force, to reduce the likelihood that the clamp will slip off under heavy pulling loads. Finally, the clamp should allow a second hydraulic jack to be connected to it to further increase the side pulling force that can be exerted on the frame, thereby reducing the number of separate pulling operations needed to straighten the frame. Until this invention, no such clamp existed.

SUMMARY OF THE INVENTION

Accordingly, it is a general object of this invention to provide a clamp that can simultaneously clamp and pull on two opposed side walls of a tube or member.

It is another object of this invention to provide a "self-energizing" dual clamp where the clamping force increases in relation to the pulling force applied to the clamp.

It is a further object of this invention to provide a clamp that can be used to clamp a wide variety of members having different shapes and cross sections.

It is still another object of this invention to provide a clamp that can exert an increased side force on the member being clamped.

Additional objects, advantages, and novel features of this invention shall be set forth in part in the description that follows, and in part will become apparent to those skilled in the art upon examination of the following or may be learned by the practice of the invention. The objects and the advantages of the invention may be realized and attained by means of the instrumentalities and in combinations particularly pointed out in the appended claims.

To achieve the foregoing and other objects and in accordance with the purposes of the present invention, as embodied and broadly described herein, the dual clamp according to this invention may comprise a first clamp assembly and a second clamp assembly, both of which are slidably mounted to an elongated slide bar. The first and second clamp assemblies are identical and comprise respective first and second pivoting jaws that are pivotally mounted to corresponding first and second sliding jaws. The first end of a pulling chain is connected to the lever end of the first pivoting jaw and the second end of the chain is connected to the lever end of the second pivoting jaw, so that when a pulling force is applied to the chain, the chain simultaneously pulls on both clamps and increases the clamping force exerted by each respective clamp assembly.

BRIEF DESCRIPTION OF THE DRAWINGS

The accompanying drawings, which are incorporated herein and form a part of the specification, illustrate preferred embodiments of the present invention and together with the description, serve to explain the principles of the invention. In the drawings.

DETAILED DESCRIPTION OF THE PREFERRED EMBODIMENT

Figure 1:
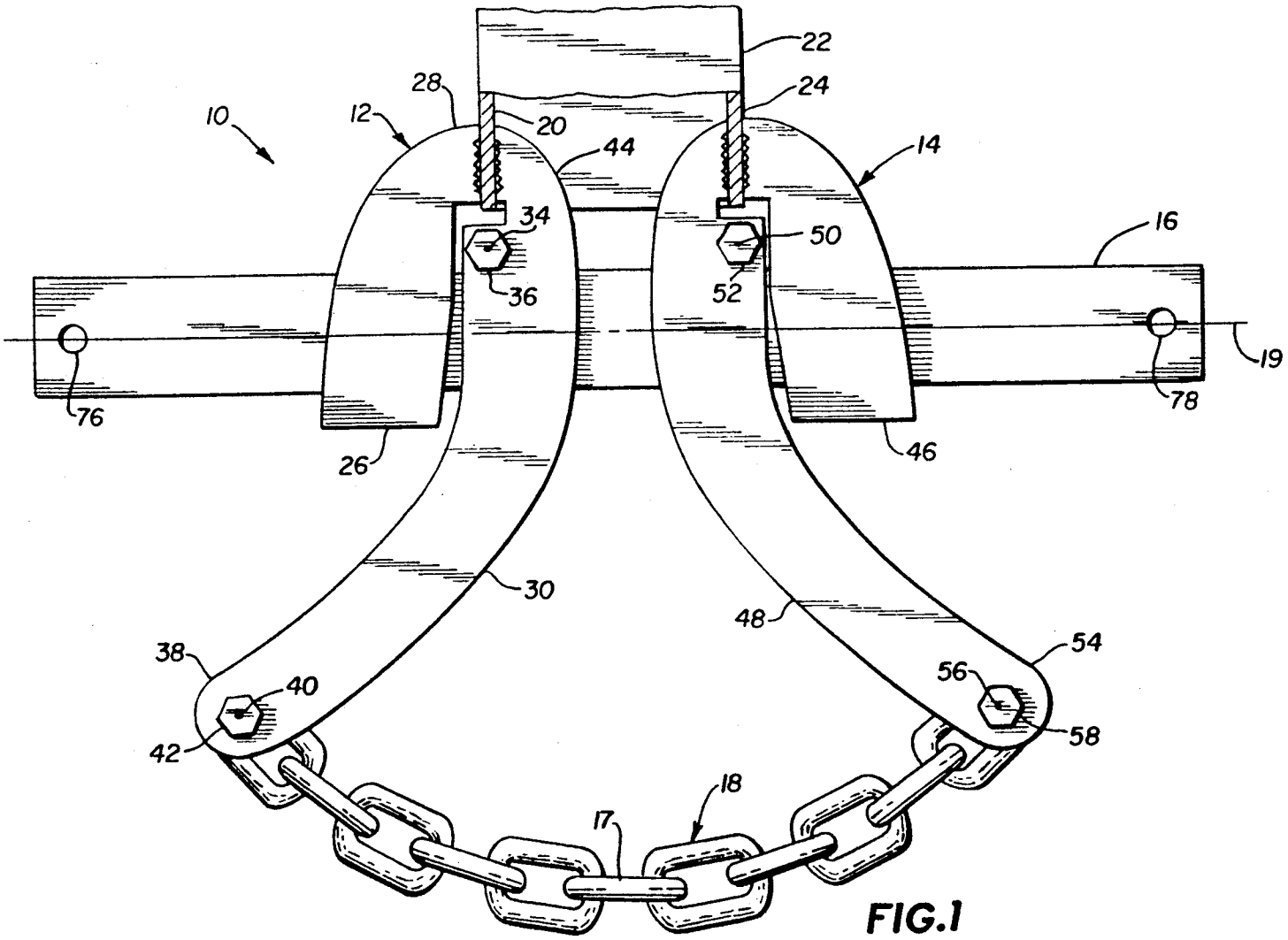
FIG. 1 is a plan view of the dual clamp according to the present invention showing how it can be secured to two opposed side walls of a tube having a rectangular cross-section.

The dual clamp 10 according to the present invention is best seen in FIG. 1 and comprises a first clamp assembly 12 and a second clamp assembly 14, both of which are slidably mounted to a slide bar 16. A chain 18 connected the first clamp assembly 12 and the second clamp assembly 14 allows the dual clamp 10 to be connected to a chain or cable (not shown) from the hydraulic pulling apparatus on the automotive frame rack (also not shown). In the preferred embodiment, the first clamp assembly 12 may be used to grip a first wall 20 of a frame member 22 having a square or rectangular cross section, while the second clamp assembly 14 may be used to grip an opposed wall 24 of frame member 22. Each respective clamp assembly 12 and 14 is slidably mounted along slide bar 16, in a manner that will be described in more detail below, so that the dual clamp 10 can be connected to a wide variety of frame members with different configurations and dimensions.

The dual clamp 10 is used by first clamping each clamp assembly 12 and 14 to the respective side walls 20 and 24 of frame 22, as best seen in FIG. 1. An end hook (not shown) from the cable or chain attached to the hydraulic jack of the frame machine can be attached to any one of the separate links of chain 18 to apply either a straight pulling force, or a pulling force having a slight side component, as would be obvious to persons having ordinary skill in the art and as will be explained in more detail below. When the hydraulic jack on the frame machine pulls on chain 18, chain 18 pulls on the clamp 10 and increases the clamping force exerted by each clamp assembly 12 and 14 on the respective sidewalls 20 and 24. Since the clamping force increases with the pulling force, the dual clamp 10 according to the present invention is "self-energizing," and the increased clamping force will help prevent the clamp from losing its grip on the frame member 22 under heavy pulling loads.

Another significant advantage associated with the dual clamp 10 is that it can simultaneously grip and pull on opposed side walls of a frame member, thereby reducing the chances of damaging or distorting the frame member while at the same time generally reducing the number of clamping and pulling operations required to straighten the member. Further, because each clamp assembly 12 and 14 is slidably mounted on slide bar 16, the dual clamp 10 can be quickly and easily adjusted to clamp a wide variety of frame styles and configurations and could even be used with on automobiles having body-on-frame construction. Finally, the slide bar 16 can be connected to a second hydraulic jack to further increase the ability of the clamp 10 to apply to the frame member a pulling force having a substantial sideways pulling component.

Figure 2:
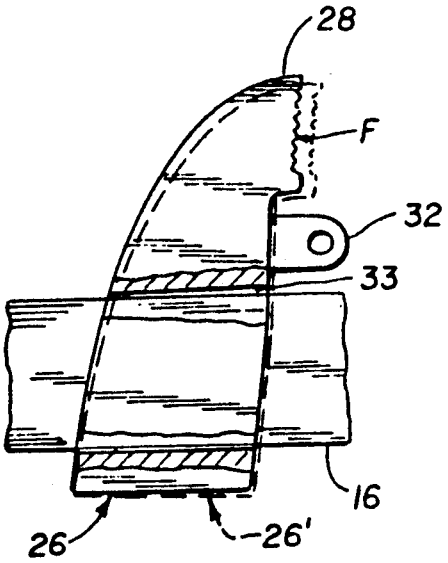
FIG. 2 is a plan view showing in solid lines the sliding jaw of the dual clamp according to the present invention in the locked or clamped position, and showing in broken lines the sliding jaw in the unlocked or free position.

The details of the preferred embodiment of the dual clamp 10 according to the present invention are best seen by referring to FIGS. 1–4 simultaneously. Essentially, the dual clamp 10 comprises two identical, but opposed clamp assemblies 12 and 14 that are slidably mounted on slide bar 16, so that they can slide along its longitudinal axis 19. The first clamp assembly 12 includes a sliding jaw 26 that is slidably mounted on slide bar 16, as best seen in FIG. 2. Sliding jaw 26 also includes a toothed clamp end 28 for gripping and clamping the side wall 20 of frame member 22. A pivoting jaw 30 is pivotally connected to the pivot boss 32 (FIG. 2) of sliding jaw 26 along a first pivot axis 34 by a first pivot bolt 36, so that the toothed clamp end 44 of pivoting jaw 30 is in opposed relation to the clamp end 28 of sliding jaw 26. One end of chain 18 is attached to the lever end 38 of pivoting jaw 30 by a bolt 42 along a first pulling point axis 40. The second clamp assembly 14 is identical to the first clamp assembly 12, except that it is a "mirror image." That is, clamp assembly 14 comprises a pivoting jaw 48 that is pivotally mounted to sliding jaw 46 along a second pivot axis 50 by a bolt 52. Similarly, lever end 54 of pivoting jaw 48 is connected to the other end of chain 18 by a bolt 58 at a second pulling point axis 56.

Figure 3:
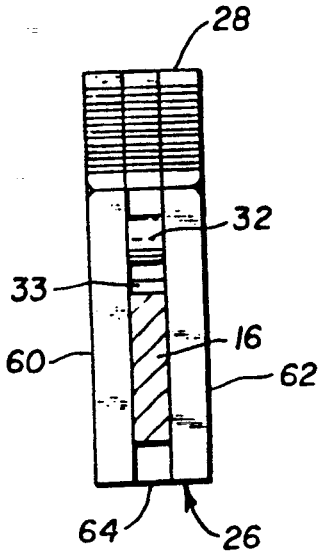
FIG. 3 is a side view in elevation of the sliding jaw shown in FIG. 2.

Since both the sliding jaws 26 and 46 are identical and since both the pivoting jaws 30 and 48 are identical, only the sliding jaw 26 and the pivoting jaw 30 will be described in detail. As mentioned above, sliding jaw 26 is adapted to be slidably mounted on the slide bar 16, as best seen in FIGS. 2 and 3. In the preferred embodiment, sliding jaw 26 comprises two jaw plates 60, 62 that are mounted in opposed relation on opposite sides of the slide bar 16. A spacer 64 and pivot boss 32 are welded in position between the two plates 60, 62, so that the sliding jaw 26 can slide freely along slide bar 16. Alternatively, sliding jaw 26 could be constructed from a single piece of material as would be obvious to persons having ordinary skill in the art after having become familiar with the details of the present invention. Sliding jaw 26 is constructed so that it can pivot slightly on slide bar 16 from an unlocked or free position 26' to a locked position 26 when a clamping force F is applied to the toothed clamp end 28 by the action of the pivoting jaw 30. Pivot boss 32 is angled slightly to create a gap 33 between the slide bar 16 and the pivot boss 32 when the sliding jaw is in the clamped position 26, causing the sliding jaw to be locked into position on the sliding bar 16.

Figure 4:
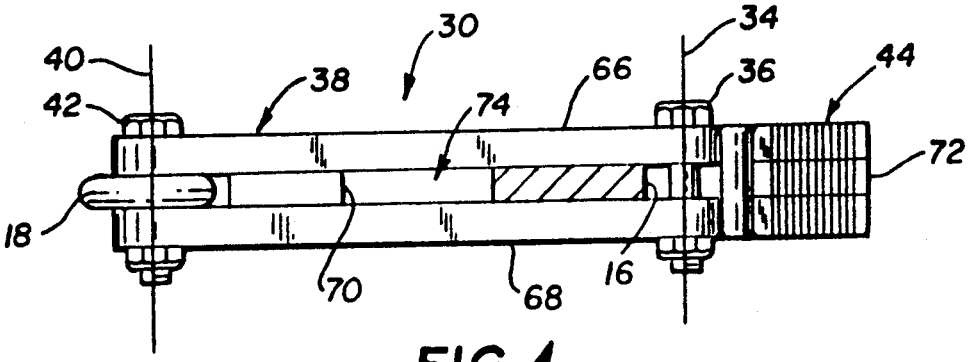
FIG. 4 is a side view in elevation of the pivoting jaw of the dual clamp according to the present invention.

The pivoting jaw 30 comprises a pair of plates 66, 68 mounted in opposed, spaced-apart relation on opposite sides of the slide bar 16, as best seen in FIG. 4. A pair of spacers 70 and 72 are welded to each plate 66, 68 to allow the pivoting jaw 30 to slide along slide bar 16. Note that spacer 70 is positioned a spaced distance away from slide bar 16 to create a gap 74 which allows the pivoting jaw 30 to pivot freely about the first pivot axis 34 without interfering with slide bar 16. As was the case for the sliding jaws 26 and 46, the pivoting jaws 30 and 48 of the present invention need not comprise two plates in opposed relation separated by spacers, but could be just as easily constructed from a single piece of material, or from multiple pieces, but in a different configuration, as would be obvious to persons having ordinary skill in the art. Consequently, the present invention should not be regarded as limited to the particular construction of the sliding and pivoting jaws shown and described herein.

The arrangement of the sliding jaws 26, 46 and pivoting jaws 30, 48 on the slide bar 16 allows the clamp assemblies 12, 14 to be positioned anywhere along slide bar 16 when the respective sliding jaws are in the unlocked or free position. Then, when the pivoting jaws 30, 48 clamp down on the respective side walls 20 and 24 of frame member 22 as a result of the pulling force exerted by the hydraulic jack on chain 18, each sliding jaw 26, 46 will pivot slightly or cock on the slide bar 16, thus locking the respective clamp assembly 12 and 14 in place. When the pulling force is removed, each clamp assembly will pivot to the unlocked or free position and again be free to slide along slide bar 16.

As was described briefly above, the chain or cable (not shown) from the hydraulic jack on the frame rack may be connected to any link of chain 18 to add the desired amount of side force to the pulling force applied to frame 22. For example, if the chain or cable (not shown) from the hydraulic jack is orthogonal to the longitudinal axis 19 when it is connected to the center link 17 of chain 18, the jack will pull straight on clamp 10 and will not exert any substantial side force on the member 22. If, however, the chain or cable (not shown) from the hydraulic jack is connected to one of the links closer to either pivoting jaw 30 or 48, the clamp will also exert a side force on the member 22. However, if even more side force is desired to be exerted on the frame member 22 than would be possible by pulling from an end link of chain 18 most proximate to either of the pivoting jaws 30 or 48, a second chain or cable from a second hydraulic jack may be connected to either of the holes 76, 78 in the slide bar 16 by a suitable clevis assembly (not shown), as would be obvious to persons having ordinary skill in the art.

This completes the detailed description of the preferred embodiment of the dual clamp 10 according to the present invention. While several equivalent structures for the sliding and pivoting jaws have been described herein that could be used with the dual clamp 10 with equal effectiveness, many other structures are possible, as would be obvious to persons having ordinary skill in the art, and the present invention should not be regarded as limited to the particular structures or alternate structures for the jaws that have been shown and described herein. Moreover, while the dual clamp 10 of this invention is designed specifically for use with automobile frame straightening machines, it could be easily adapted to be used for other purposes that require clamping and pulling an object. Therefore, the dual clamp 10 according to the present invention should not be considered to be limited to use only with automobile frame straightening machines.

The foregoing is considered illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to as falling within the scope of the invention as defined by the claims which follow.

The embodiments of the invention in which an exclusive property or privilege is claimed are defined as follows:

1. A dual clamp for clamping and pulling a member having first and second walls in opposed, spaced-apart relation, comprising:

an elongated slide bar having a longitudinal slide bar axis;

first clamp means slidably mounted to said slide bar for clamping the first wall of the member with a first clamping force, said first clamp means including a first sliding jaw with a clamp end and slidably mounted to said slide bar and a first pivoting jaw having a clamp end and a lever end, said lever end having a first pulling point axis, and wherein said first pivoting jaw is pivotally mounted to said first sliding jaw along a first pivot axis so that the clamp end of said first pivoting jaw is in opposed relation to the clamp end of said first sliding jaw;

second clamp means slidably mounted to said slide bar for clamping the second wall of the member with a second clamping force; and a chain having a first end and a second end, the first end of said chain being connected to said the first pulling point axis on said first clamp means, and the second end of said chain being connected to said second clamp means so that when a pulling force is applied to said chain, said chain increases the first clamping force exerted by said first clamp means and the second clamping force exerted by said second clamp means while simultaneously pulling on said first clamp means and said second clamp means.

2. The dual clamp of claim 1, wherein said second clamp means includes a second sliding jaw having a clamp end and slidably mounted to said slide bar and a second pivoting jaw having a clamp end and a lever end and pivotally mounted to said second sliding jaw along a second pivot axis, so that the clamp end of said second pivoting jaw is in opposed relation to the clamp end of said second sliding jaw and wherein said chain is attached to the lever end of said second pivoting jaw at a second pulling point axis.

3. The dual clamp of claim 2, wherein the distance between the first and second pivot axes is different than the distance between said first and second pulling point axes.

4. The dual clamp of claim 3, wherein the distance between the first and second pivot axes is less than the distance between said first and second pulling point axes.

5. The dual clamp of claim 4, wherein said first and second pivot axes are disposed on the opposite side of the longitudinal slide bar axis from the first and second pulling point axes.

6. The dual clamp of claim 5, wherein the distance between the first pivot axis and the longitudinal slide bar axis is different than the distance between the first pulling point axis and the longitudinal slide bar axis.

7. The dual clamp of claim 6, wherein the distance between the second pivot axis and the longitudinal slide bar axis is different than the distance between the second pulling point axis and the longitudinal slide bar axis.

8. The dual clamp of claim 7, wherein the distance between the first pivot axis and the longitudinal slide bar axis is less than the distance between the first pulling point axis and the longitudinal slide bar axis and wherein the distance between the second pivot axis and the longitudinal slide bar axis is less than the distance between the second pulling point axis and the longitudinal slide bar axis.

9. The dual clamp of claim 8, wherein each of said first and second sliding jaws are comprised of two sliding jaw members in parallel, spaced-apart relation to each other on opposite sides of said slide bar, each being adapted to slide along said slide bar and having a pivot boss disposed between the two sliding jaw members adjacent said sliding bar and positioned between said sliding bar and the clamp end, and wherein each of said first and second pivoting jaws are comprised of two elongated pivoting jaw members in parallel, spaced-apart relation to each other on opposite sides of said slide bar, each being adapted to be pivotally attached to the respective pivot boss on said first and second sliding jaws, the lever end of the respective first and second pivoting jaws also being adapted to be attached to said chain at the respective first and second pulling point axes.

10. The dual clamp of claim 9 including means attached to each end of said elongated slide bar for selectively pulling on each end of said elongated slide bar.

11. A method of clamping and pulling a member having first and second walls in opposed, spaced-apart relation, comprising the steps of:

attaching a first clamp to said first wall, said first clamp being slidably mounted to an elongated slide bar and having a sliding jaw with a clamp end and a pivoting jaw with a clamp end, wherein said pivoting jaw is pivotally mounted to the sliding jaw so that the clamp end of the pivoting jaw and the clamp end of the sliding jaw are positioned on opposite sides of said first wall;

attaching a second clamp to said second wall, said second clamp being slidably mounted to the elongated slide bar and having a sliding jaw with a clamp end and a pivoting jaw with a clamp end, wherein said pivoting jaw is pivotally mounted to the sliding jaw so that the clamp end of the pivoting jaw and the clamp end of the sliding jaw are positioned on opposite sides of said second wall, the pivoting jaw of said second clamp being connected to the pivoting jaw of said first clamp by a chain, said clamps and chain being configured so that pulling on said chain causes the respective clamp ends of the pivoting jaws of said first and second clamps to be urged toward the respective clamp ends of the sliding jaws of said first and second claims, whereby said first and second clamps grip more firmly the first and second walls; and pulling on said chain to clamp and pull the member.

12. A dual clamp, comprising:

an elongated slide bar;

a first sliding jaw having a clamp end and slidably mounted to said slide bar;

a first pivoting jaw having a clamp end and a lever end and pivotally mounted to said first sliding jaw so that the clamp end of said first pivoting jaw is in opposed relation to the clamp end of said first sliding jaw;

a second sliding jaw having a clamp end and slidably mounted to the slide bar;

a second pivoting jaw having a clamp end and a lever end and pivotally mounted to said second sliding jaw so that the clamp end of said second pivoting jaw is in opposed relation to the clamp end of said second sliding jaw; and a chain having a first end and a second end, the first end of said chain being connected to the lever end of said first pivoting jaw and the second end of said chain being connected to the lever end of said second pivoting jaw.

* * * * *